United States Patent [19]

Doherty, Jr.

[11] 4,350,967

[45] Sep. 21, 1982

[54] TWO-TEMPERATURE THERMALLY RESPONSIVE FAST IDLE CONTROL SWITCH

[75] Inventor: John Doherty, Jr., Assonet, Mass.

[73] Assignee: Texas Instruments Incorporated, Dallas, Tex.

[21] Appl. No.: 216,708

[22] Filed: Dec. 15, 1980

Related U.S. Application Data

[63] Continuation of Ser. No. 90,210, Nov. 1, 1979.

[51] Int. Cl.[3] ..... H01H 37/54

[52] U.S. Cl. ..... 337/343; 337/336; 337/354; 337/381

[58] Field of Search ..... 123/198 D, 179 G; 337/335, 336, 343, 354, 380, 381, 113, 112, 365; 335/202

[56] References Cited

U.S. PATENT DOCUMENTS

| | | | |
|---|---|---|---|
| 3,500,277 | 3/1970 | Nardulli | 337/343 |
| 3,529,272 | 9/1970 | Johnson et al. | 337/112 |
| 3,768,057 | 10/1973 | Sekira et al. | 337/349 |
| 3,893,057 | 7/1975 | Beunk et al. | 337/380 |
| 4,026,464 | 5/1977 | Doherty | 236/48 R |
| 4,117,976 | 10/1978 | Doherty | 236/48 R |
| 4,142,676 | 3/1979 | Hattori | 236/87 |
| 4,144,998 | 3/1979 | Wakabayashi et al. | 236/48 R |

FOREIGN PATENT DOCUMENTS

| | | | |
|---|---|---|---|
| 1172386 | 11/1969 | United Kingdom | 337/354 |

*Primary Examiner*—William H. Beha, Jr.

*Attorney, Agent, or Firm*—James P. McAndrews; John A. Haug; Melvin Sharp

[57] ABSTRACT

A thermally responsive electrical switch for a fast idle control in an automotive engine has two thermally responsive snap acting discs disposed in an open-ended well in a thermally conducting housing. A switch having contacts movable between open and closed circuit positions is disposed in the open end of the well and the discs are arranged to snap at respective first and second temperatures to move the contacts from one circuit position to the other and then to return to the original circuit position in sequence as the disc elements are successively heated to said first and second temperatures. Resilient conductors are mounted on the switch and are electrically connected to the respective contacts. A terminal which completes the low cost assembly is secured to the housing to press terminals of different selected types against the resilient conductors to electrically connect the terminals to the respective switch contacts and to resiliently hold the switch in place in the housing.

7 Claims, 5 Drawing Figures

TWO-TEMPERATURE THERMALLY RESPONSIVE FAST IDLE CONTROL SWITCH

This is a continuation, of application Ser. No. 90,210, filed Nov. 1, 1979.

BACKGROUND OF THE INVENTION

The field of the invention is that of thermally responsive electrical switches, particularly those adapted for use with electronic controls and the like in automotive applications.

Thermally responsive snap-acting thermostat metal discs have been used in a variety of automotive applications for performing various control functions in response to selected changes in engine temperature. It is now proposed that various electronic control means utilizing microprocessors and the like be provided for regulating operation of automotive engines to achieve improved fuel economies and efficiencies. For this purpose, it has been proposed that sensor means be arranged to provide inputs to the control means representative of various engine operating parameters such as engine temperature. For example, it has been proposed that such electronic controls be used with engine temperature sensing means for regulating fast idle means on the engine so that the fast idle means would be actuated below a first temperature during engine warm-up, would be deactuated above that first temperature during normal running of the engine, and would be reactuated if the engine were heated above a second temperature during extended standing or idling operation of the engine on a warm day, thereby to prevent vapor lock and to improve engine cooling. In this regard, it would be desirable if the temperature sensing means used with such electronic controls were adapted to provide digital signals corresponding to specific selected engine temperature conditions, thereby to facilitate signalprocessing by the electronic control. It would also be desirable if the engine temperature sensing means were compactly and inexpensively adapted to provide digital signals representative of two different engine temperatures, thereby to facilitate two-stage regulation of fast idle means and the like on the engine. It would also be desirable if such engine temperature sensing means were easily varied to sense different temperature levels and were easily adapted to be connected to electrical controls made by or for different automotive manufacturers while still being adapted for low cost mass production, whereby the sensing means could find wide application even in less expensive engine control systems.

It is an object of this invention to provide a novel and improved thermally responsive electrical switch; to provide such a switch which is adapted to respond to two different temperatures to provide digital signals representative of the temperature levels; to provide such a switch having a construction such that it is readily varied to operate at different temperatures and is easily modified to facilitate connection to controls made by different manufacturers but is also adapted for convenient and economical manufacture to achieve wide spread, low cost application. It is also an object of this invention to provide a novel and improved two-stage fast idle control system for an automotive engine using such thermally responsive electrical switch.

SUMMARY OF THE INVENTION

Briefly described, the novel and improved thermally responsive electrical switch of this invention comprises a thermally conducting cup-shaped metal housing having a well with an open end and a closed end, having first locating surfaces inside the well adjacent to and facing the open well end, and having flange means extending around the open end of the well. Preferably the housing comprises a low cost machine part having exterior screw threads for mounting the housing in close heat-transfer relation to an automotive engine, having a projection in the well upstanding from the closed well end, and having additional locating surfaces also facing the open well end but disposed relatively closer to the open end of the well.

Thermally responsive means are disposed in the well in heat-transfer relation to the housing to be movable in response to changes in housing temperature. A switch means having first and complementary contact means thereon is then positioned in the open well end by reference to the noted locating surfaces so that the first contact means are engaged at one side of the switch means by the thermally responsive means to be moved between an open circuit position spaced from the complementary contacts and a closed circuit position engaging the complementary contacts as the thermally responsive means move in the housing well in response to changes in housing temperature.

Preferably, for example, first and second thermally-responsive dished disc elements of thermostat metal are each adapted to move with snap action from an original dished configuration to an inverted dished configuration when heated to respective first and second actuating temperatures. Those elements are disposed in facing relation to each other within the housing well so that one of the elements rests on the projection at the closed housing end and so that the peripheral portions of the disc elements are aligned with each other by engagement with the side walls of the well. A spacer ring of organic material is preferably disposed between the peripheral portions of the disc elements. A guide having a flange and a bore is positioned in the open well end with the guide flange resting on the first housing locating surfaces so that the guide bore extends toward the disc elements. A motion transfer pin is slidable in the bore and rests against the other one of the two disc elements. The switch means is then disposed in the open well end to rest on the guide flange with said one side of the switch means facing the disc elements so that the first contact means is engaged by the motion transfer pin to be moved between said circuit positions as the disc elements are heated to said first and second actuating temperatures. In a preferred embodiment of the invention, the disc elements are dished so that they are nestable in their original dished configuration, whereby the elements permit the first contact means to be in open circuit position when the discs are below said first temperature. However, the two discs move the transfer pin to move the first contact means to closed circuit position when the first disc element moves to its inverted dished configuration at said first temperature and then permit the transfer pin and first contact means to return to their open circuit positions when the second disc element also moves to its inverted dished configuration. Preferably the first and second disc elements are adapted to return to their original dished configurations for reversing the noted sequence when the elements are subsequently cooled below the respective first and second temperatures.

In the thermally responsive electrical switch of this invention, resilient electrical conductors are electrically connected to the respective contact means on the noted switch means and those resilient conductors are arranged so that they can bear against the opposite side of the switch means. A terminal member having an insulating body is then provided with selected types of terminals suitable for making connection to controls of particular customers or users. A flange on the terminal body is then rested on the additional housing locating surfaces and the flange on the housing is folded over the terminal member flange for securing the terminal member to the housing. In that arrangement, the member terminals are pressed against the respective resilient conductors on the switch means and are thereby electrically connected to the respective contact means on the switch means. The engagement with the resilient conductors also serves to resiliently hold the switch means in a selected location in the open end of the housing well.

The novel and improved fact idle control system of this invention comprises conventional fast idle means and electrically operable conrol means of any conventional type using microprocessors or other electronic means or the like for actuating the fast idle means. The systems includes an electrical power source and a thermally responsive electrical switch as above described, the switch having its terminals connected to the power source and to the control means respectively and being mounted in heat transfer relation to an automotive engine for operating the control means to actuate the fast idle means when the engine is below a first temperature during engine warm-up, to deactuate the fast idle means when the engine is heated to the first temperature during normal running of the engine, and to reactuate the fast idle means when the engine is heated above a second temperature during extended idling operation of the engine.

DESCRIPTION OF THE DRAWINGS

Other objects, advantages and details of the improved thermally responsive switch and the improved fast idle control of this invention appear in the following detailed description of preferred embodiments of the invention, the detailed description referring to the drawings in which.

DESCRIPTION OF THE PREFERRED EMBODIMENTS

Figure 1:
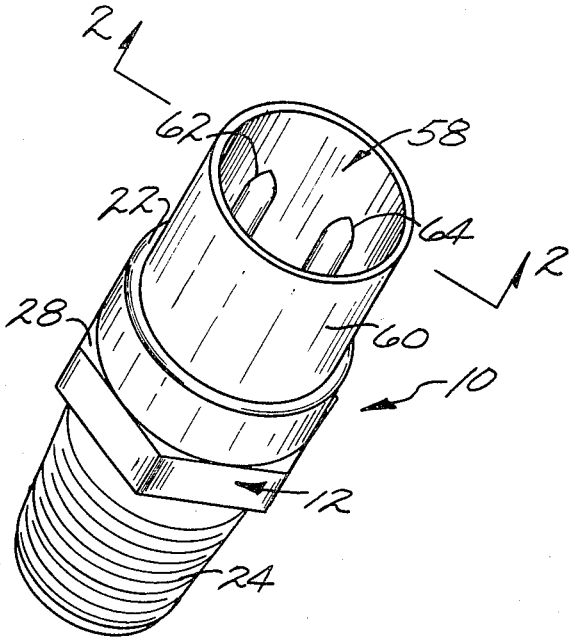
FIG. 1 is a perspective view of the novel thermally-responsive switch provided by this invention.

Referring to the drawings, 10 in FIGS. 1–5 indicates the novel and improved thermally-responsive electrical switch of this invention which is shown to include a generally cup-shaped housing 12 of a thermally-conducting metal material having a well 14 which is open at one end 16 and closed at its opposite end 18. The housing has locating surface 20 (formed by a well shoulder) disposed inside the well adjacent to and facing the open end of the well. The housing also has a flange 22 which extends around the open end of the well. In a preferred embodiment of the invention, the housing comprises a low cost machine part of brass or the like having screw threads 24 on the housing exterior near the closed housing end for threadedly mounting the housing in close heat-transfer relation to an automotive engine 26 or other object whose temperature is to be monitored as is diagrammatically indicated in FIG. 2. Preferably the housing also has a hexagonal portion 28 to facilitate mounting of the housing on the engine, has a projection 30 inside the well upstanding from the closed well end, and has additional locating surfaces 32 which also extend around the open well end but which are positioned relatively closer to the open end.

Figure 2:
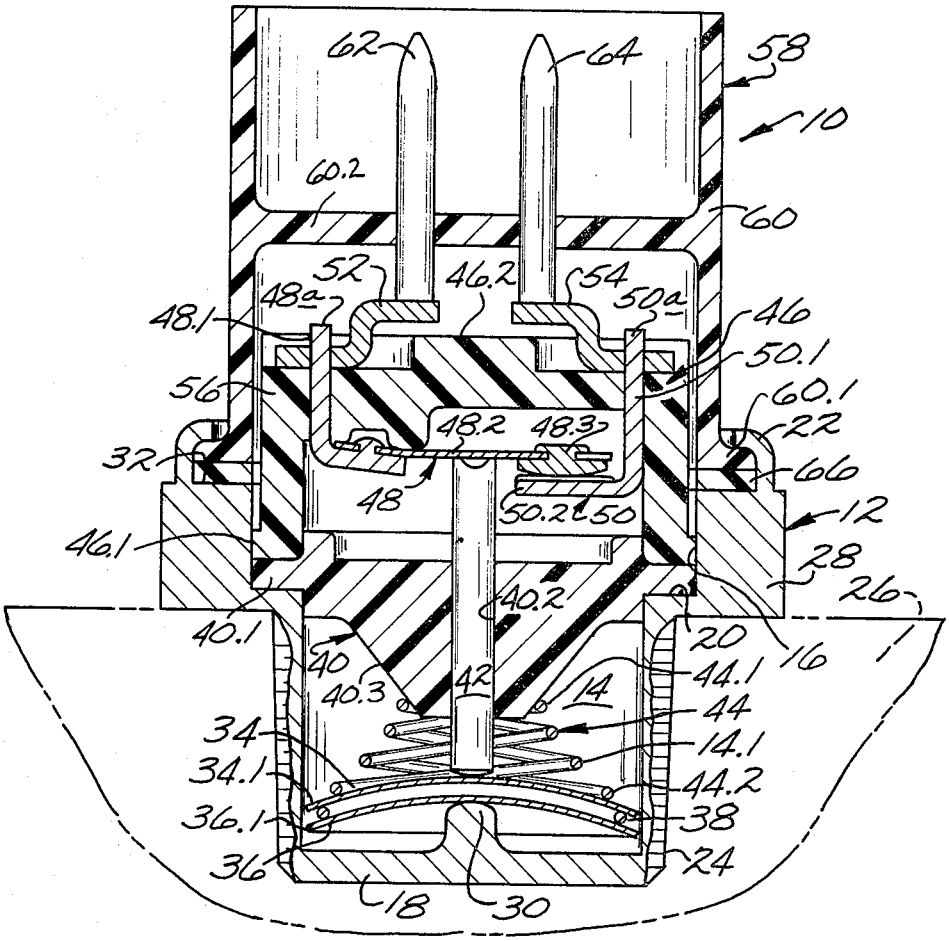
FIG. 2 is a section view to enlarged scale along line 2—2 of FIG. 1.
Figure 3:
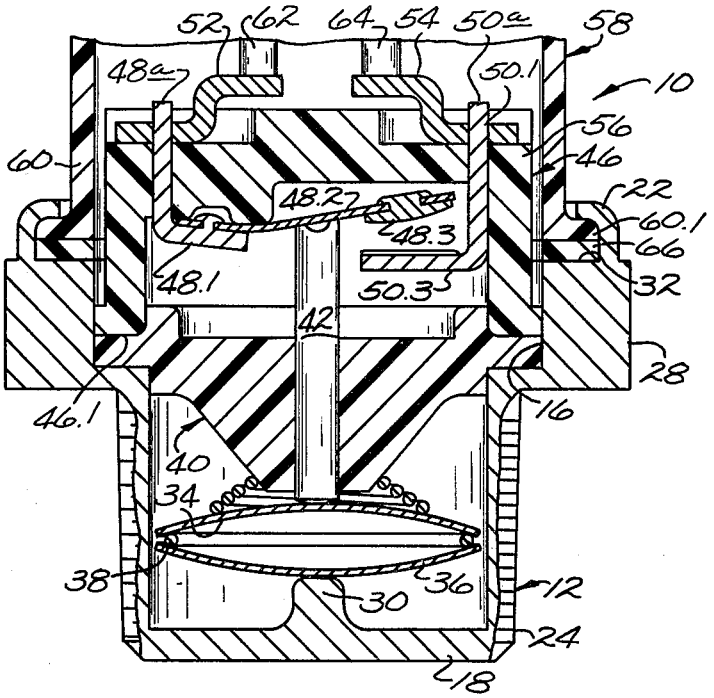
FIG. 3 is a partial section view similar to FIG. 2 illustrating the switch of FIG. 2 in an alternate stage of operation.
Figure 4:
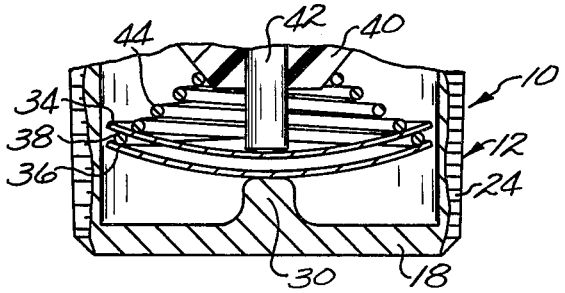
FIG. 4 is a partial section view similar to FIG. 3 illustrating another further stage in the switch operation.

First and second thermally-responsive dished disc elements 34 and 36 formed of thermostat metal are fitted inside the housing well as shown in FIGS. 2–4 so that one of the elements 36 rests on the housing projection 30 and so that the peripheral portions 34.1, 36.1 of the disc elements are aligned with each by engagement with the side walls 14.1 of the well. Although the elements 34 and 36 are shown as single layer materials for clarity of illustration, each of the disc elements is formed of a bimetallic or other conventional multilayer thermostat metal material in accordance with this invention so that each dished disc is adapted to move with snap action from an original dished configuration (as shown in FIG. 2) to an inverted dished configuration (as shown in FIGS. 3 and 4) when the discs are heated to respective selected actuating temperatures. The snap acting discs are of any conventional design according to this invention and are preferably adapted to return to their original dished configurations when they are subsequently cooled to selected levels below the noted actuating temperature. Typically for example, the first dished element 36 is adapted to snap to its inverted dished configuration at a temperature of about 95° F. while element 34 moves to its inverted shape at about 215° F. Such elements are then adapted to return to their original configurations with snap action when the second element is cooled to about 200° F. and the first element to about 75° F. A spacer ring 38 preferably formed of an organic material such as neoprene or synthetic rubber is disposed between the peripheral portions of the discs as shown in FIGS. 2–4, the nature of the spacer material being such as to frictionally engage the discs to prevent relative precessional movement of the discs when the discs are subjected to vibration.

In the preferred embodiment of this invention a guide 40 formed of a rigid glass-filled nylon material or the like has a flange 40.1 rested on the housing locating surfaces 20 and has a bore 40.2 through the guide extending toward the disc elements 34 and 36. A motion transfer pin 42 of a ceramic material or the like is slidable in the guide bore 40.2 and is arranged to rest on the first disc element 34. Preferably the guide has a tapered portion 40.3 which extends around the bore and faces toward the disc elements. A conical coil compression spring 44 is then disposed between the guide and the disc elements so that the smaller diameter end 44.1 of the spring bears against the tapered guide portion and the larger spring end 44.2 bears against the peripheral portion 34.1 of disc 34, thereby to dampen any tendency for the discs to vibrate in the well 14 during use of the switch 10.

In accordance with this invention, a switch means 46 mounts first contact means 48 and complementary contact means 50 in the open end of the housing well so that the contact means are accessible from one side 46.1 of the switch means to be engaged by the motion transfer pin 42 and to be moved between open and closed circuit positions relative to each other as the disc elements move between their original and inverted dished configurations. Resilient electrical conductors 52, 54 are electrically connected to the respective contact means and are arranged at an opposite side 46.2 of the switch means to be resiliently pressed against the switch means. Preferably, for example, the switch means is of a conventional type having a rigid body 56 of insulating material, having a first contact element 48.1 secured to the body, having a resilient contact arm or blade 48.2 mounted at one end on the element 48.1, and having a movable contact 48.3 carried at the distal end of the arm. A complementary contact element 50.1 is also secured to the body to carry a complementary or fixed contact 50.2. The arm 48.2 typically biases the contact 48.3 to a closed circuit position engaging contact 50.2 but is movable to an open circuit position spaced from the complementary contact. The contact elements 48.1 and 50.1 are typically press fitted into the body 56 and are riveted or staked to the resilient conductors 52, 54 as indicated at **48*a* and 50*a* in FIG. 2. The switch means 46 is arranged in the open end of the housing well to rest on the guide flange 40.1 so that the switch means is precisely located in the well by reference to the housing locating surfaces 20** as will be understood.

In accordance with this invention, a terminal member 58 has a main body 60 formed of an electrical insulating material and has a body flange 60.1 extending around the periphery of the member. A pair of conductive terminals 62, 64 are mounted on the member body in spaced, electrically insulated relation to each other. Preferably for example, the terminal member has a generally cylindrical shape as shown in FIG. 2 with the flange 60.1 extending around one end of the cylinder and with rigid post-type terminals extending through a web 60.2 at the center of the cylinder in sealed relation to the web and inspaced relation to each other. The member flange 60.1 is then rested against the additional housing locating surfaces 32, preferably with a gasket ring 66 therebetween, so that the end 62.1, 64.1 of the terminals are pressed firmly against the respective conductors 52, 54 on the switch means. The flange 22 of the housing is then folded over the terminal member flange by rolling or swaging or the like as shown in FIG. 2 for securing the terminal member to the housing. In that arrangement, the terminals 62, 64 are electrically connected through the conductors 52, 54 to the respective first and complementary contact means 48, 50. The engagement of the terminals with the conductors are resiliently holds the switch means 46 in a desired location in the housing relative to the housing locating surfaces 20. The terminal member also serves to close and seal the open end of the housing well.

In the thermally responsive switch 10 as above described, the thermally responsive disc elements 34 and 36 are preferably disposed in the housing well so that, when the discs are in their original configurations, the discs are normally nested as shown in FIG. 2, whereby the transfer pin 42 is positioned so that the first contact means 48 is held in closed circuit position engaging the complementary contact means 50 by the resilience or bias of contact arm 48.2. However, when the first disc element 36 is heated to its actuating temperature as noted above so that the disc moves with snap action to its inverted configuration as shown in FIG. 3, the transfer pin is pushed against the contact arm 48.2 to open the noted circuit against the bias of the arm. The second disc element 34 preferably has a relatively higher actuating temperature and accordingly, when the disc elements are further heated to move the second disc 34 to its inverted configuration, the disc elements permit the transfer pin and the first contact means to return to their original closed circuit positions as shown in FIG. 4. That is, with discs having characteristics as noted above, the switch 10 is adapted to be in closed circuit position at a temperature below a first temperature but is adapted to open the circuit and then to return to its closed circuit position in sequence as the switch is successively heated to its first and second actuating temperatures. In this regard, it will be understood that other equivalent arrangements of the switch are also within the scope of this invention. For example, if the relative position of the contacts is reversed, the noted disc arrangement is adapted to move the contacts between open, closed and open position in sequence as the discs are heated to actuating temperatures.

It will be understood that the switch 10 is adapted to be readily modified to meet the needs of different users but is also adapted to utilize many low cost and standardized components and to be conveniently and economically assembled so that the switch is commercially practical for wide application. Thus, the disc elements, guide, spring, pin and switch means are easily assembled in the low cost housing merely by being dropped into the housing well. Disc elements of different thermal response characteristics are easily selected to provide the switch with the operating temperatures needed for particular applications. The terminal member is also adapted to be of a variety of configurations and to mount terminals of a variety of shapes and types to meet the interconnection needs of different customers or applications without requiring substantial change in other more standardized switch components. However the terminal member is also adapted for convenient and accurate low cost assembly in the housing for sealing the housing and for firmly but resiliently holding the other switch components in desired locations relative to each other. The switch housing is also adapted to be easily mounted on an automobile engine or the like and to position the thermally responsive discs to be promptly and accurately responsive to changes in engine temperature.

Figure 5:
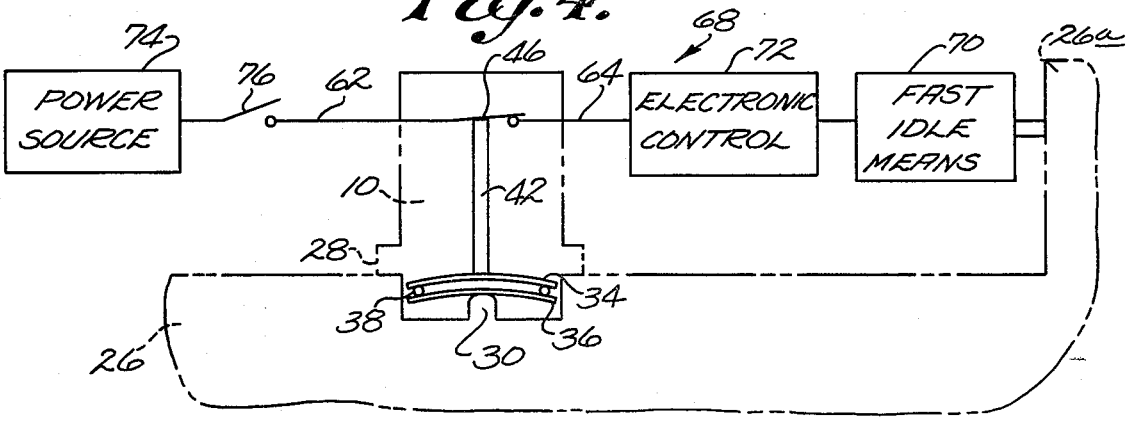
FIG. 5 is a schematic view of the fast idle control system of this invention using the thermally-responsive switch of FIGS. 1–4.

In the novel and improved fast idle control system 68 of this invention, a two-temperature thermally responsive electrical switch 10 as above described is mounted in close heat-transfer relation to an automotive engine 26 as is diagrammatically illustrated at FIG. 5. The system also includes a fast idle means 70, an electrically operable control means 72 for actuating the fast idle means, and an electrical power source 74. The switch is electrically connected between the power source and the control 72 and moves through open and closed circuit positions as exemplified above to operate the control for actuating the fast idle means 70 when the engine is at a first temperature below the actuating temperature of the disc 34 during engine warm-up, for deactuating the fast idle means when the engine is heated to said first temperature during normal running of the engine, and to reactuate the fast idle means when the engine is heated to a second temperature, the actuating temperature of the disc 36, during extended standing or idling operation of the engine.

Preferably, for example, the fast idle means 70 comprises any conventional fast idle means such as a solenoid or wax-motor operated fast idle cam or the like which is electrically actuable for adjusting a carburetor 26*a* on the engine to provide fast engine idling in conventional manner. The control 72 preferably comprises a microprocessor control or an electronic control of any conventional type which is adapted to actuate the fast idle means in response to electrical input signals furnished to the control by sensing means such as the switch 10. The power source 74 typically comprises the battery or ignition system of the engine. In that arrangement, the threaded end of the switch 10 is adapted to be conveniently mounted on the engine to be promptly responsive to changes in engine temperature. The switch terminals 62, 64 are connected to the control 72 and to the power source 74 through an ignition switch 76 or the like, whereby the control is normally provided with a digital signal calling for actuation of the fast idle means when the engine is below said first temperature during engine warm-up. That signal is then interrupted when the engine reaches normal running temperature. If the engine is heated to an excessive temperature during extended standing operation, the switch provides another digital signal to the control 72 for reactuating the fast idle means, thereby to increase standing engine speed to increase engine cooling and avoid vapor lock. When the engine returns to normal running operation after such standing, the element 36 returns to the original configuration again deactuating the fast idle means. Later when engine operation is terminated by opening of switch 76 and when the engine cools off, the element 34 resets the switch so that the fast idle means will again be actuated when the ignition switch is reclosed.

It should be understood that this invention includes all modification and equivalents of the above described embodiments of the invention which fall within the scope of the appended claims.

I claim:

1. A thermally responsive electrical switch comprising a thermally conducting housing having a well with an open end and a closed end and having flange means around the open well end, thermally responsive means disposed in the well in heat-transfer relation to the housing to move in the well in response to changes in housing temperature, and switch means having first and complementary contact means thereon positioned in the open well so that the first contact means are engaged at one side of the switch means by the thermally responsive means to be moved between an open circuit position spaced from the complementary contact means and a closed circuit position engaging the complementary contact means as the thermally responsive means move in response to said changes in housing temperature characterized in that resilient conductors are electrically connected to the respective contact means at an opposite side of the switch means to bear resiliently against the switch means, the housing has locating surfaces in the well facing the open well end, the switch means are disposed in the well resting against said locating surfaces to be positioned in a selected location in the well to assure reliable movement of the first contact means in response to movement of the thermally responsive means when selected changes in housing temperature occur, and a terminal member having an insulating body with flange means and having a pair of rigid conductive terminals is mounted on the body, the housing flange means being folded over the terminal member flange means securing the member to the housing with the rigid terminals bearing against the resilient conductors for electrically connecting the terminals to the respective contact means and for resiliently holding the switch means in said selected location in the housing well.

2. A thermally responsive electrical switch comprising a thermally conducting housing having a well with an open end and a closed end and having flange means around the open well end, thermally responsive means disposed in the well in heat-transfer relation to the housing to move in the well in response to changes in housing temperature, and switch means having first and complementary contact means thereon positioned in the well so that the first contact means are engaged at one side of the switch means by the thermally responsive means to be moved between an open circuit position spaced from the complementary contact means and a closed circuit position engaging the complementary contact means as the thermally responsive means move in response to said changes in housing temperature, characterized in that resilient conductors are electrically connected to the respective contact means at an opposite side of the switch means to bear resiliently against the switch means, the housing has locating surfaces in the well facing the open well end, the switch means are disposed in the well resting against said locating surfaces to be positioned in a selected location in the well, the thermally responsive means comprise first and second dished disc elements of thermostat metal each adapted to move with snap action from an original dished configuration to an inverted dished configuration at respective selected actuating temperatures, said elements being disposed in the housing well in facing relation to each other with peripheral portions of the elements aligned so that one of the elements rests on the closed end of the well, spacer means disposed between said peripheral portions of the elements, and motion transfer means extending between the other element and said first contact means for moving the first contact means to one of said circuit positions and then to the other of said circuit positions in sequence as said disc elements are successively heated to said selected actuating temperatures, and a terminal member having an insulating body with flange means and having a pair of rigid conductive terminals is mounted on the body, the housing flange means being folded over the terminal member flange means securing the member to the housing with the rigid terminals bearing against the resilient conductors for electrically connecting the terminals to the respective contact means and for resiliently holding the thermally responsive means in the housing well and holding the switch means in said electrical location in the well.

3. A switch as set forth in claim 2 wherein said motion transfer means comprises a guide having a bore and a flange which is held between the switch means and said housing locating surfaces for positioning the guide bore to extend along the well axis, and a motion transfer pin slidable in the guide bore between the other disc element and said first contact means.

4. A switch as set forth in claim 3 wherein the guide member has a tapered portion surrounding the guide bore and facing the disc elements, and wherein a conical coil spring has one smaller diameter end bearing against the tapered portion of the guide member centering the spring on the base and has an opposite larger diameter end bearing against the disc elements around the transfer pin securing the disc elements against vibration in the housing well.

5. A switch as set forth in claim 4 wherein the spacer means comprises a ring of organic material disposed between and frictionally engaged with said peripheral portions of the disc elements for retarding relative precessional movement between the elements in response to vibration thereof.

6. A switch as set forth in claim 3 wherein the housing has additional locating surfaces thereon and said housing flange means are folded over said terminal member flange means for securing the terminal member against said additional housing locating surfaces.

7. A thermally responsive electrical switch comprising a thermally conducting, one-piece, cup-shaped metal housing having a well with an open end and a closed end, having first locating surfaces in the well adjacent to and facing the open well end, having additional locating surfaces in the well relatively closer to and facing the open well end, having a projection in the well upstanding from the closed well end, having a flange extending around the open well end, and having exterior screw threads for mounting the housing in close heat-transfer relation to an object whose temperature is to be monitored, a first thermally responsive dished disc element of thermostat metal movable with snap action from an original dished configuration to an inverted dished configuration at a first selected actuating temperature, a second thermally responsive dished disc element of thermostat metal movable with snap action from an original dished configuration to an inverted dished configuration at a second relatively higher actuating temperature, said elements being disposed in and positioned by the well in facing relation to each other with peripheral portions of the elements aligned with each other and with one of the elements resting on said projection, a spacer ring or organic material disposed between and frictionally engaged with the peripheral portions of the dished element, a guide having a bore and a flange and having a tapered portion extending around the bore, the guide flange being disposed on the first housing locating surfaces for positioning the guide with the bore extending along the well axis and with the tapered guide portion facing the disc elements, a motion transfer pin slidable in the guide bore to engage the other disc element, a conical spring having a first smaller diameter end bearing against the tapered guide portion for centering the spring relative to the guide and having a second opposite larger diameter end bearing against said other disc element for reducing element vibration in the well, switch means having first and complementary contact means thereon and having the first contact means accessible from one side of the switch means to be moved between an open circuit position spaced from the complementary contact means and a closed circuit position engaging the complementary contact means, the switch means being disposed in the open well end with said one side resting on the guide flange and facing the thermally responsive elements for positioning the switch means in a selected location relative to the elements to be engaged by the motion transfer pin, the elements being arranged for permitting the first contact means to be in one of said circuit positions at a temperature below the actuating temperature of the first disc element and then to move the other circuit position and to return to said one circuit position in sequence as the disc elements are successively heated to said first and second actuating temperatures, resilient conductors electrically connected to the respective contact means at an opposite side of the switch means and arranged to bear against the opposite side of the switch means, and a terminal member having an insulating body with a flange and having a pair of rigid conductive terminals mounted on the body, the member flange being disposed on the additional housing locating surfaces and the housing flange being folded over the member flange securing the member to the housing with the rigid terminals bearing against the resilient conductors for electrically connecting the terminals to the respective contact means and for resiliently holding the switch means in said selected location relative to the thermally responsive elements.

* * * * *